United States Patent [19]

Pere

[11] 4,344,834

[45] Aug. 17, 1982

[54] APPARATUS FOR COOLING AND PURIFICATION OF EXIT GASES FROM AN ELECTROLYSIS INSTALLATION

[75] Inventor: Gérard Pere, Le Breuil, France

[73] Assignee: Creusot-Loire, Paris, France

[21] Appl. No.: 145,752

[22] Filed: May 1, 1980

[51] Int. Cl.[3] ..... C25B 9/00

[52] U.S. Cl. ..... 204/278

[58] Field of Search ..... 204/237, 129, 256, 258, 204/265-266, 270, 277-278, 274; 55/183, 195, 208

[56] References Cited

U.S. PATENT DOCUMENTS

| | | | |
|---|---|---|---|
| 1,965,813 | 7/1934 | Stuart | 204/278 X |
| 3,385,779 | 5/1968 | Nishiba et al. | 204/237 X |
| 3,410,783 | 11/1968 | Tomter | 204/129 X |
| 3,945,908 | 3/1976 | Hempell et al. | 204/270 X |
| 4,105,528 | 8/1978 | Hasebe | 204/237 |
| 4,113,601 | 9/1978 | Spirig | 204/237 X |

*Primary Examiner*—Delbert E. Gantz
*Assistant Examiner*—Donald R. Valentine
*Attorney, Agent, or Firm*—Pollock, Vande Sande & Priddy

[57] ABSTRACT

The invention relates to the cooling and purification of exit gases from an electrolysis installation, such as an installation for electrolysis of water under pressure. Above each degasser (7) is placed a chamber (1) containing a volume (3) of pure water, cooled by a cooling circuit (2). The gas bubbles are led into the chamber (1) by conduit (5), traverse the volume of pure cooled water (3) and leave purified by way of upper outlet (4). The invention finds use in the industrial production of hydrogen and oxygen by electrolysis of water.

2 Claims, 2 Drawing Figures

APPARATUS FOR COOLING AND PURIFICATION OF EXIT GASES FROM AN ELECTROLYSIS INSTALLATION

The present invention relates to the cooling and purification of exit gases of an electrolysis installation intended for the industrial production of hydrogen and oxygen by electrolysis of water under high pressure and high temperature.

The gaseous extracts from an industrial electrolysis installation under pressure, such as hydrogen and oxygen in the case of electrolysis of water, leave the gas-liquid separators, or "degassers", at elevated temperature often higher than 100° C., charged with steam and impurities in the form of aerosols consisting of, for example, traces of potash. Therefore, these gases, on leaving the degassers, should be cooled so as to condense the steam which they contain, and should be purified.

In actual installations, the exit gases from the degassers are successively treated in separate apparatus each one having its own function. First the gases traverse a first purification apparatus, called a "splash head", for the purpose of retaining the aerosols and consisting, for example, of one or more plates placed in the path of these gases. The gases thus partially purified then pass into a liquified-gas refrigerant which cools them to a temperature sufficient to obtain condensation of the steam which they contain. In a last step finally, the gases thus treated enter a purifier, charged with alumina, for example, intended to eliminate final traces of impurities. The invention, on the contrary, only requires a single apparatus of reduced dimensions, and is particularly simple to carry out. It is characterized in that it consists of having the gases which issue from the gas-liquid separators pass through at least one volume of washing liquid, at a temperature sufficiently low to condense the steam contained in said gases.

The invention will be better understood from the following description by way of a non-limiting example of a cooling and purification installation associated with an electrolyzer of water under pressure and putting the process into practice according to the invention, with reference to the attached drawings in which.

Figure 1:
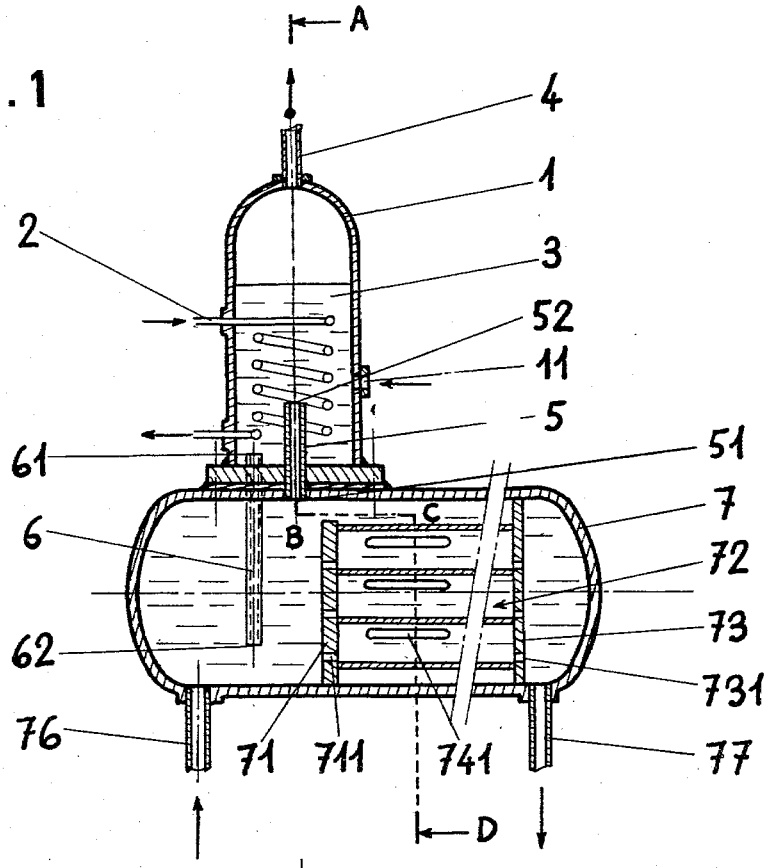
FIG. 1 is a side view of an apparatus for exit gases of electrolysis according to the invention.
Figure 2:
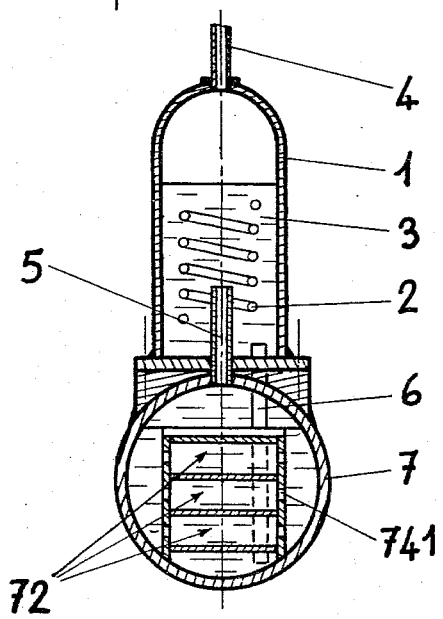
FIG. 2 is a view taken along the broken line ABCD of FIG. 1.

Referring to the combination of FIGS. 1 and 2, reference 7 designates a degasser for an electrolysis installation, of the gravity type and in the example considered. In a manner known per se, the degasser 7 is provided with an inlet 76 for the mixture of liquid electrolyte, anolyte or catholyte as the case may be, and of gas, oxygen or hydrogen respectively, with at least one upper conduit 5 for exit of gas alone, with an outlet 77 for degasified liquid electrolyte, and with complementary separation cells 72, three in number in the example considered. The warm electrolyte charged with gases enters the degasser 7 by conduit 76, traverses the cells 72 by means of passages 711 of the entry plate 71 and passages 731 of the exit 73, then leaves degassified through conduit 7 toward the return circuit of the electrolyte. The gas bubbles coalesced on the internal surfaces of cells 72 escape through side orifices 741 and finally accumulate on the upper part of the degasser 7 where they exit through outlet 5.

According to the invention, conduit 5 opens into a chamber 1, located above the separator 7, and contains a volume 3 of pure or demineralized water. The volume of water 3 is in addition traversed by a cooling circuit consisting of a coil 2 in which cold water circulates, at a temperature of about 20° C., for example, which permits conferring on water volume 3 a temperature of about 30° C. in the example under consideration, sufficient to produce condensation of the steam contained in the gas bubbles escaping from the upper outlet 52 of conduit 5.

The gas bubbles passing from orifice 51 of the outlet of the degasser 7 towards chamber 1 thus traverse the pure, cooled water volume 3. They are, in the course of this passage, washed of their impurities and cooled so as to condense the steam which they contain, the condensate obtained being added to the pure water already constituting volume 3. Then they leave perfectly purified through outlet 4 situated in the upper part of chamber 1.

The level of pure water in chamber 1 is maintained more or less constant owing to a pressure regulator, not shown, located in the circuit 4 of the exit gases and acting on a valve, not shown, controlling an inlet 11 for demineralized water into chamber 1. In addition, the return of the condensation water through the electrolysis circuit is effected by at least one pipe 6 connecting the interior of chamber 1 with the interior of degasser 7, from the upper inlet 61 to the lower outlet 62 of said pipe, which in addition permits ensuring a good equilibrium of the pressures between chambers 1 and 7. It will be noted that one can add demineralized water during the operation of the electrolyzer through orifice 11 into chamber 1, instead of adding it as is usual directly into the degasser 7: thus one will limit concentration gradients.

In the example considered, by another way, it is possible in starting up, to introduce electrolyte into chamber 1 instead of introducing pure water thereto. This modification will only be temporary because, in proportion to the condensation of steam and the evacuation of liquid by pipe 6, volume 3 will contain, at the end of a certain operating time and with the exception of traces of potash, no more than practically pure water. Finally it will be noted that the cooling circuit realized in chamber 1 due to coil 2 and the liquid volume 3 is a liquid-liquid circuit, which permits constructing chamber 1 itself with dimensions which are much smaller than those previously required only for the cooling circuit which was a liquid-gas circuit.

The invention finds its principal use in the industrial production of hydrogen and oxygen by electrolysis of water under pressure.

I claim:

1. An apparatus for cooling and purifying gases exiting from a conduit of a degasser in an electrolysis installation, said apparatus comprising a chamber for demineralized water connected to said conduit and located above said degasser, at least one exterior inlet for said water, a coil within said chamber, a source of cold water connected to said coil for cooling the water in said chamber, an outlet on said chamber for exit of cooled purified gases and a pipe connecting said chamber to said degasser for return of water to said degasser wherein said exterior inlets constitute the only supply for demineralized water for said electrolysis installation.

2. The apparatus according to claim 1 wherein said chamber is fixed on the top of said degasser.

* * * * *